US005116062A

United States Patent [19]

Johnson

[11] Patent Number: 5,116,062

[45] Date of Patent: May 26, 1992

[54] GAME APPARATUS AND METHOD OF PLAYING

[76] Inventor: Palmer M. Johnson, 703 E. Second St., Seymour, Ind. 47274

[21] Appl. No.: 629,394

[22] Filed: Dec. 18, 1990

[51] Int. Cl.[5] ..... A63F 3/02

[52] U.S. Cl. ..... 273/260; 273/272; 273/291

[58] Field of Search ..... 273/260, 261, 292, 291, 273/272

[56] References Cited

U.S. PATENT DOCUMENTS

| | | | |
|---|---|---|---|
| 574,192 | 12/1896 | Climenson | 273/260 |
| 613,550 | 11/1898 | Ballou | 273/260 |
| 809,502 | 1/1906 | Hale | 273/242 |
| 1,529,987 | 3/1925 | Buker et al. | 273/260 |
| 3,761,092 | 9/1973 | Shieff | 273/260 |
| 3,989,253 | 11/1976 | Schifman | 273/260 |
| 4,289,314 | 9/1981 | Berlino | 273/260 |

FOREIGN PATENT DOCUMENTS

| | | | |
|---|---|---|---|
| 2617053 | 12/1988 | France | 273/260 |

OTHER PUBLICATIONS

Popular Science, Jun. 1971, "Two Way Checkers" Game offered by Yippy, Inc., New York, N.Y.

Arithmechips Game Information—Hammett Catalog, Trademark Application Specimen and Rules.

*Primary Examiner*—Benjamin Layno
*Attorney, Agent, or Firm*—Woodard, Emhardt, Naughton, Moriarty & McNett

[57] ABSTRACT

A board game for two players includes a game board consisting of ten rows of eight squares each arranged like in an alternating pattern of playing and non-playing squares. Each player is provided with two sets of game pieces with each set consisting of twelve game pieces individually and consecutively numbered 1 through 12. On one set of game pieces the sides are marked with the mathematical symbols for addition and subtraction. On the other set of game pieces the mathematical functions of multiplication and division are represented. The game pieces of the opponent are similarly configured in two sets with the same numbering and the same mathematical functions. The only difference between the two sets of game places of each player are their color so as to distinguish the pieces of one player from those of the other. The game is played in a conventional manner much like the traditional game of Checkers with the players moving forward, jumping, removing the jumped piece and becoming a king. Points are scored not only for winning the game but additionally points are scored by performing the mathematical function represented by each jump.

15 Claims, 2 Drawing Sheets

GAME APPARATUS AND METHOD OF PLAYING

BACKGROUND OF THE INVENTION

The present invention relates generally to educational and instructional board games for play by two or more persons where turns are taken to advance game pieces and capture the game pieces of the other player(s). More particularly, the present invention relates to a checkers-type game where the game pieces are marked with a mathematical function and a numeral which is used to determine a point value each time another game piece is taken.

The game of Checkers is certainly well-known and widely played and over the years there have been a number of variations to the basic game apparatus and method of play. The game of Chinese Checkers is one such variation where game pieces are advanced and jumps taken all in an effort to reach a particular objective. In both regular Checkers and Chinese Checkers, the focus is on the play of the game and the strategy employed by each player to out smart and out maneuver the opponent(s) in order to successfully capture the opponent's game pieces or be the first to achieve some objective. If anything is taught by these games, it is limited to the play of the game and game strategies generally.

There have been attempts to create a greater learning experience with checkers-type games as evidenced by the patents to Climenson and Ballou. In U.S. Pat. No. 574,192 issued to Climenson on Dec. 29, 1896, the game board is square in shape with 100 (10×10) individual game squares. These individual game squares are alternately arranged in a light and dark color pattern and the entire game is played using only one of the two sets of differently colored and alternately colored squares. The outer most border of game squares (36 total) constitutes a disqualification area. Any game piece which is forced to jump so as to land on one of the border squares is disqualified from the game. The interior game squares are arranged in an 8×8 pattern for 64 total squares and the colored squares which are used for play of the game (32 total) are each permanently marked with a numeral and a mathematical function such as addition, subtraction, multiplication or division.

Each player has 12 game pieces which are numbered and arranged on 12 of the 32 squares in three rows, the same as is done when playing Checkers. As the game is played, the pieces are moved diagonally and jumping of opposing pieces as required. Any piece which is jumped remains on the board and the player making the jump is entitled to score a certain number of points based on the number of his game piece and the number and function of the vacant square where his game piece lands after the jump. The player with the greatest point total is the winner of the game.

The play of the Climenson game is more complex than Checkers and requires more time to play a game in that the game pieces are not removed after being jumped. Whatever educational value there may be from calculating the score is limited by the lack of uniformity in the mathematical functions which appear on the 32 game squares. If a student desires to practice multiplication by playing the game, it is conceivable that the entire game might be played with only one or two multiplication calculations being required for the student. Fixing the configuration of the board limits the games versatility and precludes a focus on one type of mathematical function for instructional purposes.

In U.S. Pat. No. 613,550 issued to Ballou on Nov. 1, 1898 the game board is a larger version of a checker board having 14 squares on a side for 196 total squares. Twenty-six (26) of the 28 alternating squares of the center 4 rows are marked with the numeral and the selected corners of the selected squares in this center of 4 rows are marked with one or two dots. Each player has 21 game pieces which are arranged on alternating squares in the first three rows at his end of the board. The two players take turns moving diagonally with the objective being to reach the 4 rows in the center portion of the board. Once a player's game piece passes over a diagonal row of 4 squares a numerical value is computed based on the dots which are in the corners of the squares which are passed through in moving across the 4 rows. For example, moving across the squares marked 4, 10, 10, and 5 results in a dot expression of 4:10::10:5 which according to the rules of ratio and proportion requires one to multiply the extremes and means and divide the greater product by the lesser to achieve the result. In this case, multiplying the extremes results in 20 and multiplying the means results in 100. The larger product 100 divided by the smaller product 20 gives the result of 5 which according to the rules of the game means that the player successfully moving across the 4-10-10-5 diagonal row gets to remove 5 game pieces of his opponent.

In this game, no jumping is allowed except when both players have game pieces in the numbered squares and no backward moves are allowed until the numbered squares have been crossed and the opponents kingdom is entered. The game is called "ratio" and is limited in play and educational value by fixing the numerical markings on the center rows of the board.

For a less complicated game there is a Checkers adaptation once offered by Yippy, Inc. of New York, N.Y. referred to as "Two Way Checkers". In this game, the checker pieces are assigned a value of 1,5,10 or 25 points in order to add a new dimension to the game. As the advertisement for the game states, "straight piece-for-piece trades are out—why lose a 25 to kill a 1?". This game, even more so than the games disclosed by the Climenson and Ballou patents is geared solely to gain play strategy. There are no real educational or instructional aspects as to mathematics except an appreciation of numbers and which ones are larger.

Another game which attempts to combine mathematics with board game play is offered by Creative Toys Ltd. under the name "Arithmechips". The game board includes a 9×9 matrix of 81 squares and 169 playing chips. Each chip includes a mathematical expression on one side such as "19−11=" and the answer, 8, is displayed on the opposite side of the corresponding chip. The "Arithmechips" game is sold in three versions, one version is subtraction, one is addition and the third is multiplication. Each game version is structured such that every playing chip has a mathematical expression corresponding to the specific version. For example, if the subtraction version is selected, all 169 playing chips have a subtraction expression displayed on one side of the chip and the correct answer to the subtraction expression is displayed on the opposite side of the chip.

Playing chips are selected at random and placed on 80 of the 81 squares leaving the center square vacant. One player moves first by jumping over one chip, and landing on the vacant square. The jumping player then collects the chip which was jumped over and must answer the problem correctly in order to keep the chip. The object is to collect chips not score points. Multiple jumps are permitted similar to those allowed in the game of Checkers and if more than one chip is collected the problems must all be answered correctly in order to keep all the chips. Once there is a miss in answering the mathematical expression correctly that chip and all those left (yet unanswered) as part of the same multiple jump are returned to the game board with the answer side laid face down. When no jumps can be made the game is over and the chips of each player are counted.

One drawback of this game is the inability to practice the different mathematical functions without having to buy two or three different versions of what would otherwise be the same game. Another drawback is the time it takes to play. Assuming that games such as this will be used by grade schools as well as households with small children, it is important to have a faster paced game and one which can be played in 10 to 15 minutes so as to hold the interest of the players. In view of the fact that one aspect of the "Arithmechips" game and the game of the present invention is for educational and instructional purposes, the actual play of the game needs to be short enough so as to hold the interest of the players. Games which take substantially longer to play such as 45 to 55 minutes are not as suitable for this age of player nor for use during a school class period or recess period. If the game cannot be finished in a class period or recess period the children will not be inclined to start the game. While some educational or instructional value may still be realized in a partially played game, the children still like the idea of competition and winning. The game in their minds is played to see who wins and who loses. If there is not enough time to finish the game a significant part of why the game is played is lost.

The present invention offers a simple, fast paced game that is played somewhat like Checkers but can be played with one game apparatus in anyone of four different mathematical functions consisting of addition, subtraction, multiplication and division. The players select the function to be used and the game pieces are oriented accordingly. There is no penalty for wrong answers since the players want to be encouraged to learn and not to be penalized for an error. The game takes about the same amount of time as Checkers and the game can be easily completed in part of a grade school class period or recess period. As will be described hereinafter, the present invention overcomes the problems and drawbacks in the earlier games in a novel and an obvious manner.

SUMMARY OF THE INVENTION

A game apparatus for play by a plurality of players according to one embodiment of the present invention comprises a game board divided into rows of alternate playing and non-playing squares of contrasting colors and a plurality of game pieces for each player, each game piece of said pluralities having disposed thereon a numeral and a mathematical function symbol.

A method of playing a game board game by two players according to another embodiment of the present invention comprises the steps of providing a game board which is divided into rows of alternate playing and non-playing squares of contrasting color, providing a plurality of game pieces for each player wherein each of the plurality of game pieces of each player has disposed on one side a number and a mathematical function symbol, the numbering of the game pieces and the selection of the mathematical function symbol being the same for both pluralities of game pieces for each player, arranging the game pieces of each player on the playing squares of a plurality of rows at opposite ends of the game board, beginning play by having a first player move a game piece forward diagonally to a contiguous playing square and then having the other player making a similar move of a selected game piece also forward diagonally to a contiguous playing square and repeating these two steps with the additional move option of jumping in a straight diagonal line any opponents game piece which is on a contiguous playing square to a vacant game square, performing the mathematical function which appears on the jumping game piece using the numbers on the jumping game piece and the jumped game piece of the opponent and recording the numerical score of the mathematical function using the two game piece numbers and totalling the score as the game continues until all of the game pieces of one player have been jumped and removed from the game board.

One object of the present invention is to provide an improved board game and method of playing for educational and instructional purposes.

Related objects and advantages of the present invention will be apparent from the following description.

DESCRIPTION OF THE PREFERRED EMBODIMENT

Figure 1A:
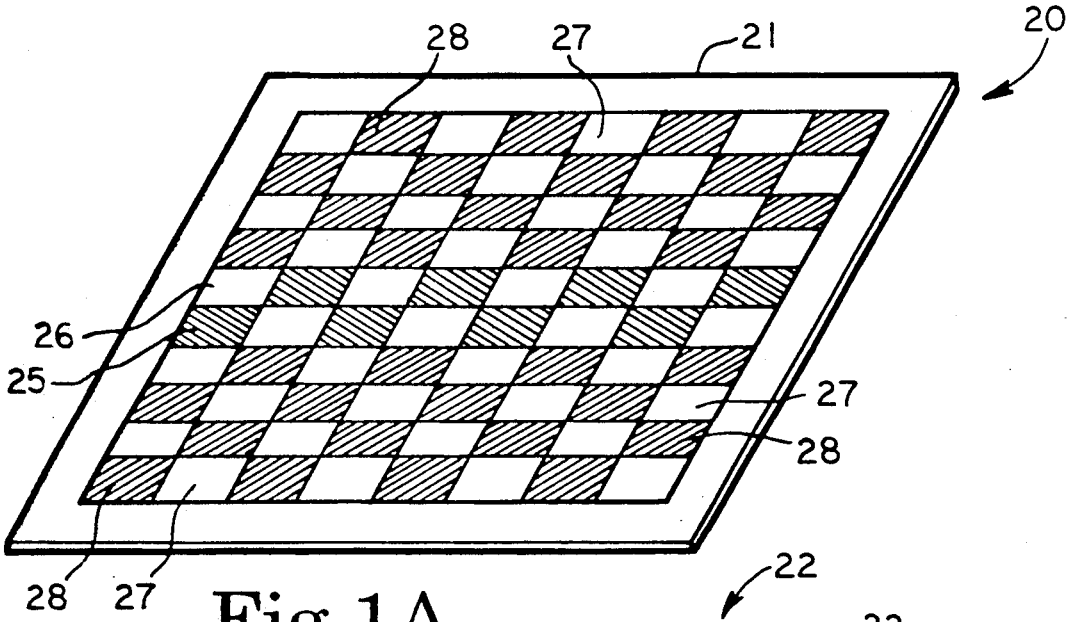
FIGS. 1A, 1B, and 1C are perspective views view of the component parts of a game apparatus according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1B:
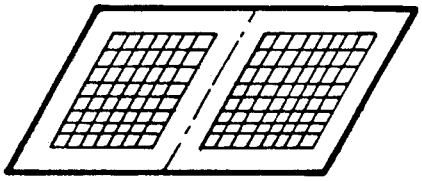
Figure 1C:
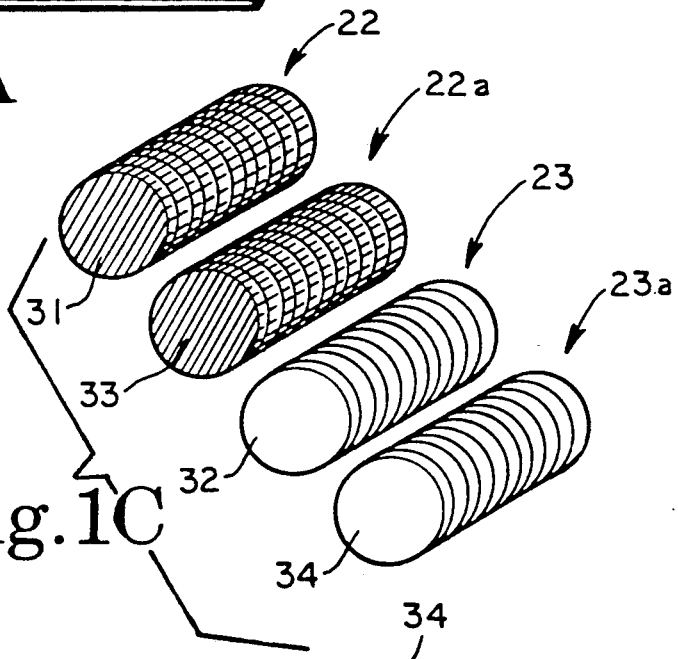
Figure 2:
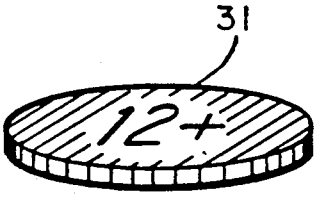
FIGS. 2 and 2A are perspective views of a game piece of one player.

FIGS. 1A, 1B, and 1C collectively illustrate the components of game apparatus 20 which include game board 21, including 80 squares in an alternating checkerboard figuration, four sets 22, **22*a*, 23, and 23*a* of game pieces (checkers) and mathematical tables 24** for the mathematical functions of multiplication and division.

Game board 21 is an $8 \times 10$ matrix of squares with two rows 25 and 26 of bonus squares whose use will be described hereinafter. These two rows are alternately colored with playing and non-playing squares, but the color used for the playing squares is different from the color used for the other eight rows of playing squares. The remaining 8 rows, 4 on each side of the bonus rows are configured like a conventional checkerboard. The light squares 27 and dark squares 28 alternate throughout the entirety of the board and during the play of the game only one color of game squares will be used. The selected color of squares will be designated as the playing squares and the alternate color which is not used will be designated as the non-playing squares. Since the playing squares are arranged contiguous to one another but only on a diagonal line, moves must be made diagonally and unless a game piece is kinged the moves must be forward which in this context means in the direction of the opponents side or end of the board. It is to be understood that movement of the game pieces and play of the game is substantially like the traditional game of Checkers, it being a requirement that a jump must be taken if available. Multiple jumps are also permitted just as they would be in the traditional game of Checkers.

Set 22 of game pieces includes twelve pieces 31 of one color which are individually and consecutively numbered 1 through 12. As illustrated in FIGS. 2, 2A, 3 and 3A each game piece is a shallow cylindrical disk or checker-like member and is numbered with the same number on each side. Additionally, on one side of each game piece 31 is a plus sign to represent the mathematical function of addition. On the opposite side of each game piece 31 is a minus sign to represent the mathematical function of subtraction. For example, in FIGS. 2 and 2A one game piece 31 of set 22 is illustrated with the number 12 on each side accompanied by a plus sign on one side and a minus sign on the opposite side. The other eleven pieces of set 22 are the same as the piece illustrated except for bearing numbers 1 through 11 so that all twelve numbers are used and no two pieces are the same.

Set 23 of game pieces 32 is identical to set 22 except set 23 is of a different and contrasting color from that of set 22. Like game pieces 31, game pieces 32 are twelve in number and are numbered 1 through 12 such that each piece is different and no two game pieces are the same. Game pieces 32 of set 23 also contain mathematical function symbols for addition on one side and subtraction on the opposite side.

Set **22*a* of game pieces includes twelve pieces 33 which may alternately be used by the player in control of set 22. Set 22*a* is identical to set 22 except for the selected mathematical functions which are displayed on each side of game pieces 33. While game pieces 31 include the functions for addition and subtraction, game pieces 33** contain the symbols for the mathematical functions of multiplication and division.

Figure 3:
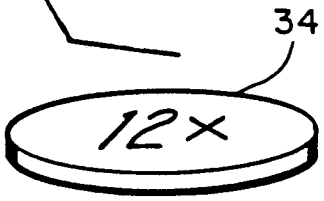
FIGS. 3 and 3A are perspective views of a game piece of another player.
Figure 2A:
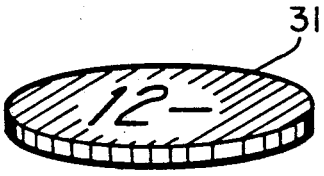
Figure 3A:
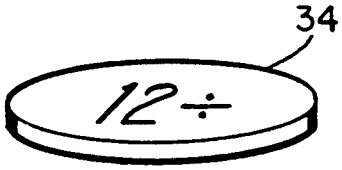

Set **23*a* is likewise identical to set 23 except that game pieces 34 include the mathematical function symbols for multiplication and division (See FIGS. 3 and 3A). Pieces 34 are identical to pieces 33** except for the color so as to designate one set for one player and the contrasting color for the other player.

Based on the foregoing description, it should be understood that set 22 consists of 12 game pieces numbered 1 through 12 with a plus sign on one side and a minus sign on the opposite side. Set **22*a* consists of game pieces numbered 1 through 12 with the multiplication sign on one side and the division sign on the opposite side. Sets 23 and 23*a* are identical to sets 22 and 22*a*** except for the color. There are thus four possible choices for the players to make with regard to what mathematical function they wish to practice. If the players decide that they wish to practice addition, then the 12 game pieces of each player with the plus symbol are selected and are placed on the game board with the plus symbol facing up. If multiplication is the agreed selection of the players then the game pieces with the multiplication symbol are selected and arranged on the game board with that symbol face up.

With regard to the play of the game there are actually two competing game strategies at work. On the one hand each player is trying to collect points by jumping the game pieces of the other player. The point value is determined by the mathematical function and thus if the selected game function is either multiplication or addition these will present a slightly different strategy than would subtraction and division. The other strategy is to try and win the checkers part of the game. If a player is successful at trapping and multiple jumps, he should be able to gain an advantage in the game and not only capture all of the opponents game pieces but create preferential game piece swaps by trading jumps. The winner of the game is awarded 50 points, or any other value agreed to by the players, and the agreed value can be dwarfed in comparison to one 12 over 12 jump with the multiplication function selected. However, for subtraction and division games the suggested 50 points for winning the checkers part of the game may be significant.

Figure 4:
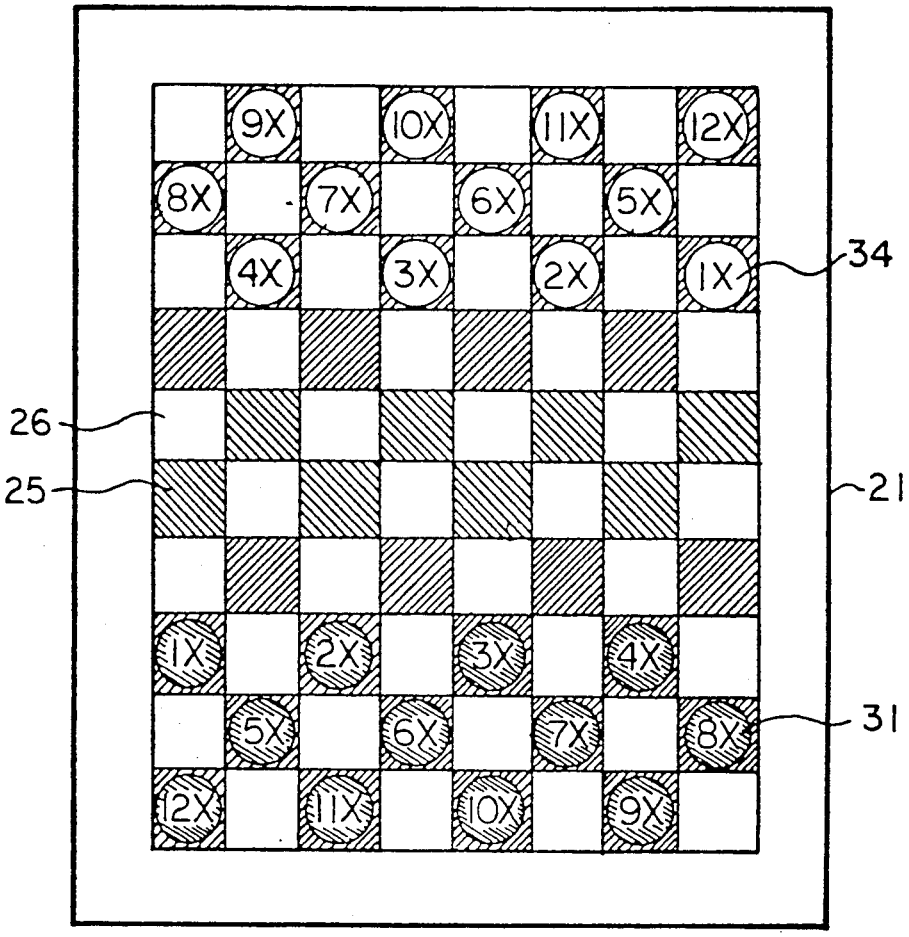
FIG. 4 is a perspective view of the game board as initially set up to begin play of the game according to a typical embodiment of the present invention.

Referring to FIG. 4 game apparatus 20 is arranged for the start of the play. In this example, two players have selected the mathematical function of multiplication. The twelve game pieces 33 of one player are numbered 1 through 12 and alternately arranged with the multiplication sign facing up on the first three rows at one end or side of game board 21. The twelve game pieces 34 of the other player also numbered 1 through 12 and oriented with the multiplication sign facing up are alternately arranged on the first three rows on the opposite end of game board 21.

The twelve game pieces of each player are arranged with the lower numbered pieces positioned toward the center of the board and the higher numbered pieces positioned in the back or kings row. More specifically, game pieces numbered 1 through 4 are in the forward row, game pieces numbered 5 through 8 are in the middle row and game pieces numbered 9 through 12 are in the back or kings row. This particular starting configuration for the twelve game pieces of each player may either be required or may be optional. If the game is played with the starting position for the twelve pieces unspecified, except for the pieces being positioned in the first three rows, one reasonable game strategy suggests protecting the higher number pieces until the later stages of play. Even if the players agree to a specified positioning of the twelve game pieces row by row, the exact placement in each row from left to right may vary. The point to be made is that the positioning of the twelve game pieces on the designated three rows can be fixed or random however the two players agree to play the game. The important fact is that the learning experience remains the same. Regardless of how the twelve numbered game pieces are arranged on the three rows it will not affect the practicing of the mathematical function selected for that game.

Figure 5:
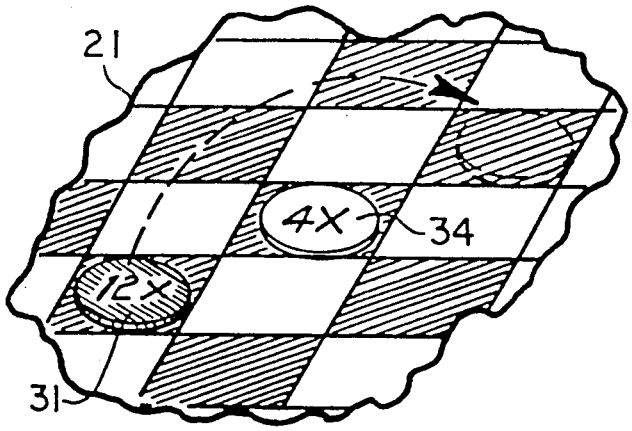
FIG. 5 is a partial perspective view of the FIG. 1 game board during play diagrammatically illustrating a jump being made according to the rules of the game.

Referring to FIGS. 4 and 5 play of the game begins with one player moving first and moving one of his front row game pieces out of that front row in a forward diagonal direction to a contiguous, same colored vacant space. Rather than elaborate on all rules regarding movement, directions, jumping, kinging, etc. it should suffice to explain that movement of the game pieces and the rules of play as to jumping, multiple jumps, moving forward unless kinged and getting kinged are the same as the rules for the convention game of Checkers. The only differences include the two bonus rows 25 and 26 and the method of scoring. Additionally, when one player successfully travels the length of the board and reaches the kings row of the opposing player that game piece is kinged and the game piece selected for kinging will be from those game pieces already jumped and removed from the board. The rules specify that the game piece used for kinging will be the game piece with the highest point value of those game pieces taken from the player being kinged. The rule is specified in this manner because the strength of a king and its ability to move in either direction makes it a more valuable and stronger game piece and as it jumps the game pieces of the opponent a larger point value on the king will result in a larger score for the player with the king. However, recognizing the versatility offered by the present invention the players may agree to suspend that particular rule and allow the game piece used for kinging to be any of those pieces then removed from the game board.

Referring to FIG. 5 the jumping of a game piece and corresponding mathematical calculation is illustrated. As diagrammatically illustrated game piece 33 bearing the number 12 and belonging to one player jumps the game piece 34 bearing the number 4 and belonging to the other player. The jumping player records the result of the mathematical function, in this case $12\times4$ or 48. The jumping player may state the function represented by the two game pieces involved and the answer to the mathematical expression at the time the jump is taken. If needed, tables 24 are used to check the answer. Whether the player is correct or incorrect in his response he still records the point value of 48. This point total is added to other scores generated during the play of the game as part of determining the winner. As previously mentioned, the player which actually wins the checkers part of the game scores an additional 50 points which is then added to the mathematical function point totals to determine the game winner.

If the game piece which is jumped is positioned on one of the playing squares of rows 25 or 26 then the answer of the mathematical function (such as $12\times4$) is doubled. The players can agree that the two bonus rows will have some other multiplier or some additive point value, but the two bonus rows are intended to supplement the score of the jumping player.

As an alternative to the score-as-you-play approach, the jumping player can merely write down on a tablet or score pad the expression $12\times4$ and then perform the mathematical function after the game is finished. If each mathematical expression is merely written down as jumps are made throughout the play of the game but not answered, then there will be a greater element of uncertainty in the outcome of the game since the individual points are not totalled as the game proceeds. If bonus points are to be added based on a jump in rows 25 or 26, a notation of this must be made. The game is over when all of the game pieces of one player have been jumped and removed from the board by the other player. Alternatively, if play of the game results in each player having one game piece left that would be regarded as a draw or stalemate, the game should be called at that point.

One reason for not penalizing the player for an incorrect answer is to preclude any chilling effect on the game strategy. If the player is uncertain of the correct mathematical answer to a particular expression he may make other moves which would be ill advised for a winning game strategy. Since this game is designed as teaching and instructional aid for smaller children, the enjoyment of playing the game is important. If the best move is avoided because the player is hesitant regarding his ability to answer the mathematical expression correctly, it would detract from the game. The players are encouraged to play the game with a winning strategy and if the answer is incorrect the player will hopefully learn from that mistake.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

I claim:

1. A game apparatus for play by a plurality of players comprising:

a game board divided into rows of alternate playing and non-playing squares of contrasting colors; and a plurality of game pieces for each player, each game piece of said pluralities having a playing surface facing upwardly with only one number and one mathematical function symbol disposed on said playing surface.

2. The game apparatus of claim 1 wherein said game board squares are free of any alphanumeric indicia.

3. The game apparatus of claim 2 wherein said game board is configured with 10 rows of 8 squares each.

4. The game apparatus of claim 3 wherein the playing squares of the center two rows of the game board are colored differently from the playing squares of the four rows on each side of said center two rows.

5. The game apparatus of claim 1 wherein said game board is configured with 10 rows of 8 squares each.

6. The game apparatus of claim 5 wherein the playing squares of the center two rows of the game board are colored differently from the playing squares of the four rows on each side of said center two row.

7. The game apparatus of claim 1 wherein the game pieces of each player are all of the same color which is different from the color of any other game pieces.

8. The game apparatus of claim 7 wherein each player has twelve game pieces each of which are individually and consecutively number 1 through 12.

9. A game apparatus for play by a plurality of players comprising:

a game board divided into rows of alternate playing and non-playing squares of contrasting colors; and a plurality of game pieces for each player, each game piece of said pluralities having disposed thereon a numeral and a mathematical function symbol wherein the game pieces of each player are all of the same color which is different from the color of any other game pieces, and wherein the game pieces of each player have two sides and are numbered on each side and each side includes a mathematical function symbol.

10. The game apparatus of claim 9 wherein all the game pieces of each player have the same first mathematical function symbol on one side and the same second mathematical function symbol on the other side, said first and second mathematical function symbols being different from one another.

11. A method of playing a board game by two players which includes a game board divided into rows of alternate playing and non-playing squares of contrasting color and a plurality of game pieces for each player wherein each of the pluralities of game pieces of each player has a playing surface facing upwardly with only one number and only one mathematical function symbol disposed on said playing surface, the numbering of game pieces and the selected mathematical function symbol being the same for both pluralities, said method of playing comprising the following steps:

providing said game board and said pluralities of game pieces;

arranging the game pieces of one player on the playing squares of a plurality of rows at one end of the game board;

arranging the game pieces of the other player on the playing squares of a plurality of rows at the opposite end of the game board;

beginning play by having one player move a first game piece forward diagonally to a contiguous playing square;

moving a game piece forward diagonally to a continuous playing square by the other player;

repeating the prior two steps with the additional move option of jumping in a straight diagonal line any opponents game piece which is on a contiguous playing square onto a vacant playing square which is contiguous to the opponents game piece, the jumped game piece being removed from the game board;

performing the mathematical function which appears on the jumping game piece using the numbers on the jumping game piece and the jumped game piece of the opponent to generate a numerical score; and recording the numerical score of each player for each jump as play continues.

12. The method of claim 11 which includes the additional step of kinging any game piece which reaches the back row of his opponent and permitting the kinged game piece to move in any direction.

13. The method of claim 12 which further includes arranging the game board with ten rows of eight squares each and designating the two center rows as bonus scoring rows which change the regular score otherwise computed based on the numbers of the game pieces involved in a jump and the mathematical function.

14. A game apparatus for play by a plurality of players comprising:

a game board divided into rows of alternate playing and non-playing squares of contrasting colors; and a plurality of game pieces for each player, each game piece of said pluralities having disposed thereon a numeral and a mathematical function symbol, wherein the game pieces of each player have two sides and are numbered on each side and each side includes a mathematical function symbol.

15. The game apparatus of claim 14 wherein all the game pieces of each player have the same first mathematical function symbol on one side and the same second mathematical function symbol on the other side, said first and second mathematical function symbols being different from one another.

* * * * *